US011849781B1

(12) United States Patent
Merrill

(10) Patent No.: US 11,849,781 B1
(45) Date of Patent: Dec. 26, 2023

(54) FUNCTIONAL FIT SYSTEM FOR APPAREL

(71) Applicant: U.S. Government as Represented by the Secretary of the Army, Natick, MA (US)

(72) Inventor: Haile A. Merrill, Natick, MA (US)

(73) Assignee: Government of the United States as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/727,882

(22) Filed: Apr. 25, 2022

Related U.S. Application Data

(63) Continuation of application No. 16/426,009, filed on May 30, 2019, now abandoned.

(51) Int. Cl.
*A41D 13/02* (2006.01)
*A41D 1/06* (2006.01)
*A41D 3/00* (2006.01)

(52) U.S. Cl.
CPC ..... *A41D 13/02* (2013.01); *A41D 1/06* (2013.01); *A41D 3/00* (2013.01); *A41D 2300/22* (2013.01); *A41D 2300/32* (2013.01); *A41D 2300/322* (2013.01)

(58) Field of Classification Search
CPC ..... A41D 2300/22; A41D 1/02; A41D 15/002
See application file for complete search history.

(56) References Cited

U.S. PATENT DOCUMENTS 4,065,814 A * 1/1978 Fox ..... A41D 13/02 482/124
4,573,218 A * 3/1986 Saggs ..... A41D 15/002 2/93
4,583,478 A * 4/1986 Bassetti ..... A41F 9/025 2/221
4,697,288 A * 10/1987 Palumbo ..... A41D 15/002 2/919
4,910,802 A * 3/1990 Malloy ..... A63B 21/4009 2/69
5,186,701 A * 2/1993 Wilkinson ..... A63B 21/00065 482/121

(Continued)

FOREIGN PATENT DOCUMENTS

DE 202004012222 U1 * 11/2004 ..... A41D 15/002
FR 2129092 A5 * 10/1972

(Continued)

*Primary Examiner* — Megan E Lynch
(74) *Attorney, Agent, or Firm* — Timothy M. Barlow

(57) ABSTRACT

Apparel that is adjustable. For example, in one embodiment, the apparel is provided that includes a torso. The torso includes a front, a back, a first side connecting the front to the back, a second side connecting the front to the back, a bottom, and a top. A plurality of shell fabric portions is on the torso. Each portion in the plurality of portions of shell fabric is adapted to receive an elastomeric member. Bunched fabric is on the first side and second side of the torso. Pleats are on the front of the torso. A centrally located flap is on the torso and has a longitudinal axis that is substantially vertical. Sleeves are connected to the torso. A first zipper track is located on the bottom of the torso. Pants may include a second zipper track adapted to mate with the first zipper track and secure the pants to the torso.

13 Claims, 13 Drawing Sheets

(56) References Cited

U.S. PATENT DOCUMENTS 5,778,452 A * 7/1998 Dicker ..... A63B 21/00185 2/69
5,820,534 A * 10/1998 Vadher ..... A63B 21/0552 482/125
5,839,122 A * 11/1998 Dicker ..... A63B 21/4025 2/69
5,946,724 A * 9/1999 Erickson ..... A41D 3/00 2/93
6,401,249 B2 * 6/2002 Haar ..... A42B 3/0406 2/88
7,171,695 B2 * 2/2007 Braun ..... A41D 27/28 2/93
7,412,728 B2 * 8/2008 Alesina ..... A41D 27/28 2/93
7,966,669 B1 * 6/2011 Siepmann ..... A41D 15/002 2/123
8,083,644 B2 * 12/2011 Purdy ..... A41D 31/18 482/4
8,544,114 B2 * 10/2013 Williams ..... A41D 13/0015 482/121
2007/0271668 A1 * 11/2007 Pape ..... A41D 13/0015 2/69
2010/0144490 A1 * 6/2010 Purdy ..... A63B 21/4007 2/69
2010/0199404 A1 * 8/2010 Garza ..... A41D 3/02 2/244
2013/0318680 A1 * 12/2013 Keathley ..... A41D 13/0015 2/69
2016/0183606 A1 * 6/2016 Shriver ..... A63B 21/0552 2/69
2017/0280791 A1 * 10/2017 Spenser ..... B63C 11/04
2018/0064181 A1 * 3/2018 Skurla, III ..... A41D 3/00
2018/0255853 A1 * 9/2018 Spathas ..... B65D 33/00
2020/0205487 A1 * 7/2020 Fujihara ..... A41F 1/00

FOREIGN PATENT DOCUMENTS

FR 2601859 A * 1/1988 ..... A41D 1/082
GB 225790 A * 12/1924
GB 1169592 A * 11/1969

* cited by examiner

FUNCTIONAL FIT SYSTEM FOR APPAREL

CROSS-REFERENCE TO RELATED APPLICATIONS

This application claims benefit under 35 U.S.C. § 119(e) of U.S. Provisional Patent Application No. 62/678,394, filed on May 31, 2018, and is incorporated herein by reference in its entirety.

STATEMENT OF GOVERNMENT INTEREST

The invention described herein may be manufactured and used by or for the U.S. Government for governmental purposes without the payment of any royalties thereon or therefor.

FIELD

Embodiments of the present disclosure generally relate to apparel and more specifically to apparel that is configurable.

BACKGROUND

Coveralls can generally be referred to as garments that protect a wearer from external elements (e.g., environmental temperatures, exposure to chemicals, dirt, etc.). Coveralls can also include some type of shielding material to protect a user's body-parts. However, coveralls restrict a user's movements and need repeated adjustment when the uniform moves unwantedly in response to the user's movements. In addition, any one coverall is typically configured to fit a relatively narrow range of user sizes, height and/or other body dimensions.

SUMMARY

Embodiments of the present disclosure generally relate to apparel and more specifically to apparel that is configurable. For example, in one embodiment, the apparel is provided that includes a torso. The torso includes a front, a back, a first side connecting the front to the back, a second side connecting the front to the back, a bottom, and a top. A plurality of shell fabric portions is on the torso. Each portion in the plurality of portions of shell fabric is adapted to receive an elastomeric member. Bunched fabric is on the first side and second side of the torso. Pleats are on the front of the torso. A centrally located flap is on the torso and has a longitudinal axis that is substantially vertical. Sleeves are connected to the torso.

In another embodiment, pants are provided that include a waist portion. A vertical flap is also included that extends downward and away from the waist portion. The vertical flap includes two vertical pieces that each includes a proximal end and a distal end. The distal ends of the two vertical pieces are directly connected to each other. A protective barrier connects the proximal ends of the two vertical pieces. The protective barrier extends upwards and away from the waist portion and the protective barrier is connected to the directly connected distal ends. Two legs extend from the waist portion. Each of the two legs include: multiple zipper tracks where each of the multiple zipper tracks is separated from one another by extension material and another zipper track that is adapted to mate with any of the multiple zipper tracks. Each of the two legs also includes a leg flap that exposes the multiple zipper tracks and the another zipper track when the leg flap is in a first position and covers the multiple zipper tracks and the another zipper track when the leg flap is in a second position.

In yet another embodiment, apparel is provided that includes a torso having a front, a back, a first side connecting the front to the back, a second side connecting the front to the back, a bottom, and a top. The apparel includes a plurality of shell fabric portions on the torso where each portion in the plurality of portions of shell fabric is adapted to receive an elastomeric member. Bunched fabric is on the first side and second side of the torso. Pleats are on the front of the torso. A centrally located flap is also on the torso and has a longitudinal axis that is substantially vertical. Sleeves are connected to the torso portion. A first zipper track is located on the bottom of the torso and behind the protective flap. A second zipper track is coupled to and is above a waist portion and is adapted to mate with the first zipper track. A vertical flap extends downward and away from the waist portion. The vertical flap includes two vertical pieces that each includes a proximal end and a distal end, the distal ends of the two vertical pieces are directly connected to each other. A protective barrier connects the proximal ends of the two vertical pieces. The protective barrier extends upwards and away from the waist portion. The protective barrier is connected to the directly connected distal ends of the two vertical pieces. Two legs extend from the waist portion. Each of the two legs includes multiple zipper tracks separated from one another by extension material and another zipper track that is adapted to mate with any of the multiple zipper tracks. A leg flap exposes the multiple zipper tracks and the another zipper track when the leg flap is in a first position (i.e., an "up" position) and covers the multiple zipper tracks and the another zipper track when the leg flap is in a second position (i.e., a "down" position).

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

Embodiments presented herein are illustrated by way of example, and are not limited by the accompanying figures, in which like references indicate similar elements. Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

In the following description, numerous specific details are set forth to provide a more thorough understanding of the invention. As will be apparent to those skilled in the art, however, various changes using different configurations may be made without departing from the scope of the invention. In other instances, well-known features have not been described in order to avoid obscuring the invention. Thus, the invention is not considered limited to the particular illustrative embodiments shown in the specification and all such alternate embodiments are intended to be included in the scope of the appended claims.

When a user makes certain movements such as fully extending their arm(s) and/or bending over, the bottom of a typical jacket moves towards the user's armpit(s) and away from the user's waistline and/or the sleeve cuff(s) moves away from the user's wrist(s) and towards the armpit(s). However, after these movements and other user movements which cause movement of the apparel, the apparel can become uncomfortable and require a user to spend time readjusting the apparel. In addition, typical apparel is designed to fit when a user is standing "at attention" or "at ease" but provide a limited range of motion without needing readjustment. Embodiments described herein provide a greater range of motion without as much readjustment as typical apparel. Embodiments described herein also accommodate a wider array of users having different dimensions (e.g., inseam, waist size and wingspan) than an array of users provided by typical apparel.

Figure 1:
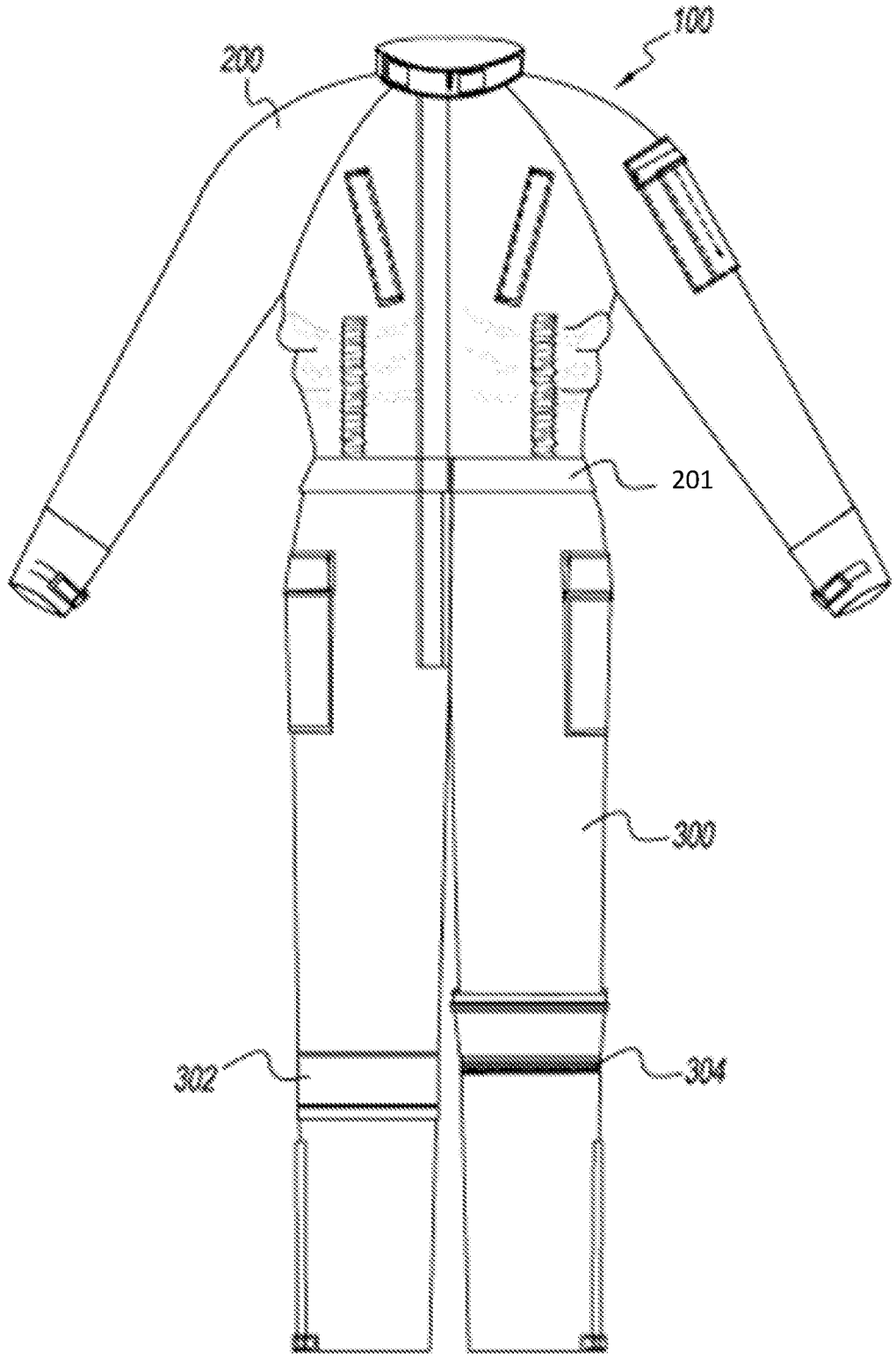
FIG. 1 depicts an embodiment of apparel in accordance with the material disclosed herein.

FIG. 1 depicts an embodiment of apparel 100 in accordance with the material disclosed herein. For illustrative purposes only, apparel 100 is depicted in FIG. 1 and described herein as "coverall 100." However, the material described herein may be used with other types of apparel. For example, the material described herein may be used on shirts and pants.

The coverall 100 can be divided into two sections: an upper portion 200 (hereinafter described as "jacket 200") and a lower portion 300 (hereinafter described as "pants 300"). A "jacket" as used herein is defined as any apparel that covers a user's torso above the user's waistline. The jacket 200 may be secured to the pants 300 under a protective flap 201 on the jacket 200. The jacket 200 and pants 300 are described in greater detail below.

Figure 2A:
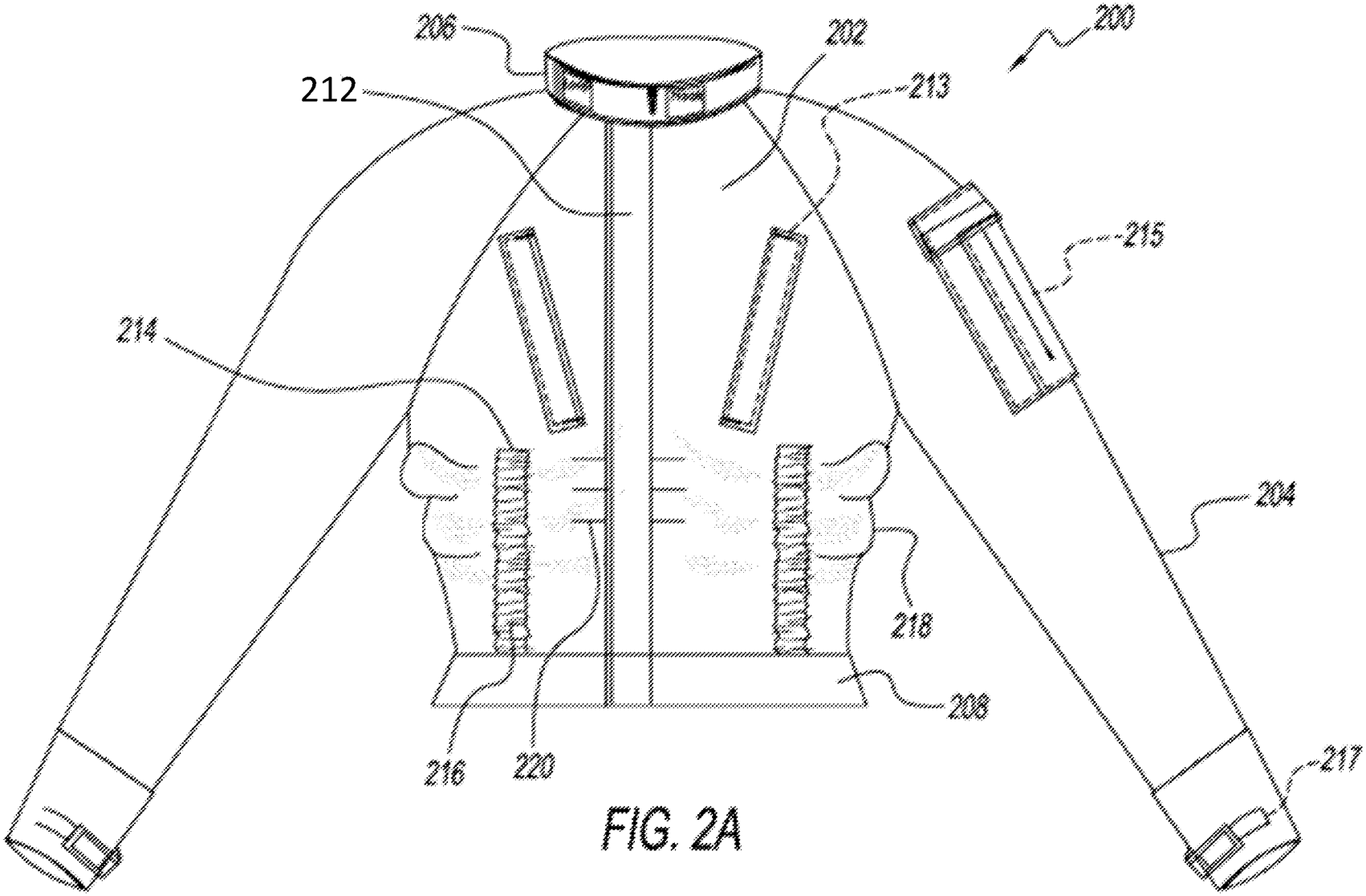
FIG. 2A depicts an embodiment of apparel in accordance with the material disclosed herein.

FIG. 2A depicts an embodiment of a jacket 200 in accordance with the material disclosed herein. The jacket 200 includes a torso 202 having a front and a back (not shown in FIG. 2A), sleeves 204, a collar 206, a flap 208 near a user waist and at the bottom of the torso 202, a vertical strap 212, bunched material 218 on the left side and right side of the torso 202, and multiple pleats 220 on the front of the torso 202.

The front of the torso 202 includes a vertical flap 217 that is a hook and loop fastener that protects a zipper or other fastening mechanism (not shown in FIG. 2A) that is used to close the jacket 200. Collar 206 may also include a hook and loop fastener to adjust the size of the collar.

A "zipper" as used herein is broadly defined as a mechanism that includes a first track having a plurality of hooks and hollows that are adapted for engaging/disengaging with a plurality of hooks and hollows on a second track when a zipper slide passes alongside the first and second track. The zippers described herein may be either "individual element zippers" or "coil zippers." Although the use of "hook and loop" fasteners and zippers are described herein other embodiments use "snaps."

The front of the torso 202 also includes a plurality of substantially vertical tunnels 214. The tunnels 214 are used to house elastomeric material 216. "Tunnels" as used herein are extra shell fabric that include enough material to receive an elastomeric material and accommodate stretching of the elastomeric material and wearer movements. "Elastomeric material" as used herein is any stretchable material having a memory that once inserted into a tunnel (e.g., the tunnel 214) in a stretched state and sewn into place urge the tunnel and surrounding apparel material to bunch. The top and bottom of the elastomeric material 216 are sewn to the top end and bottom end of the tunnel 214. Types of elastomeric material that may be used include, but are not limited to, braided elastic, knit elastic, cord elastic, buttonhole elastic, and drawstring elastic. Factors that may be used when selecting the elastic used depends upon the amount of stretch needed, the material used to make the jacket 200 and the strength of the elastic needed to return the elastic to its non-stretched position causing the material near a tunnel and elastomeric material to bunch.

When moving, a user may move their body to a first orientation causing the typical jacket to move in a corresponding manner to accommodate the user's movements. However, after the user moves away from the first orientation to a second orientation, portions of the typical jacket may not correspondingly move and may require adjustment by the user. For example, when a user stretches their arms upwards, the cuffs on the sleeves move downward and away from the user's wrists; and the bottom of the typical jacket moves upwards and away from the user's waistline. When the user lowers their arms the cuffs of the sleeves and bottom of the typical jacket are still in locations with respect to the wrists and waist corresponding with the first orientation. In addition, when the jacket 200 is connected to the pants 300 raising the arms may allow the crotch of the pants 300 to rise and cause discomfort to the wearer.

The bunched material 218 and pleated material 220 allows freedom of movement and provides room to accommodate users having various amounts of girth. The elastomeric material 216 provides memory which urges locations influenced by the elastomeric material 216 back to their bunched location prior to the first orientation (i.e., back to a resting position or an "at-ease position").

Examples of locations where elastomeric material may be located are provided in other figures described herein. Some of the embodiments described herein may combined to form another embodiment. Also included on the jacket 200 (as well as jackets 203, 205, 207, 209, and 211) are optional features such as for example: at least one optional pocket 215 on at least one of the sleeves 204, at least one optional pocket 213 on the front of the torso 202 and optional adjustment straps 217 on the cuffs of the sleeves 204.

Figure 2B:
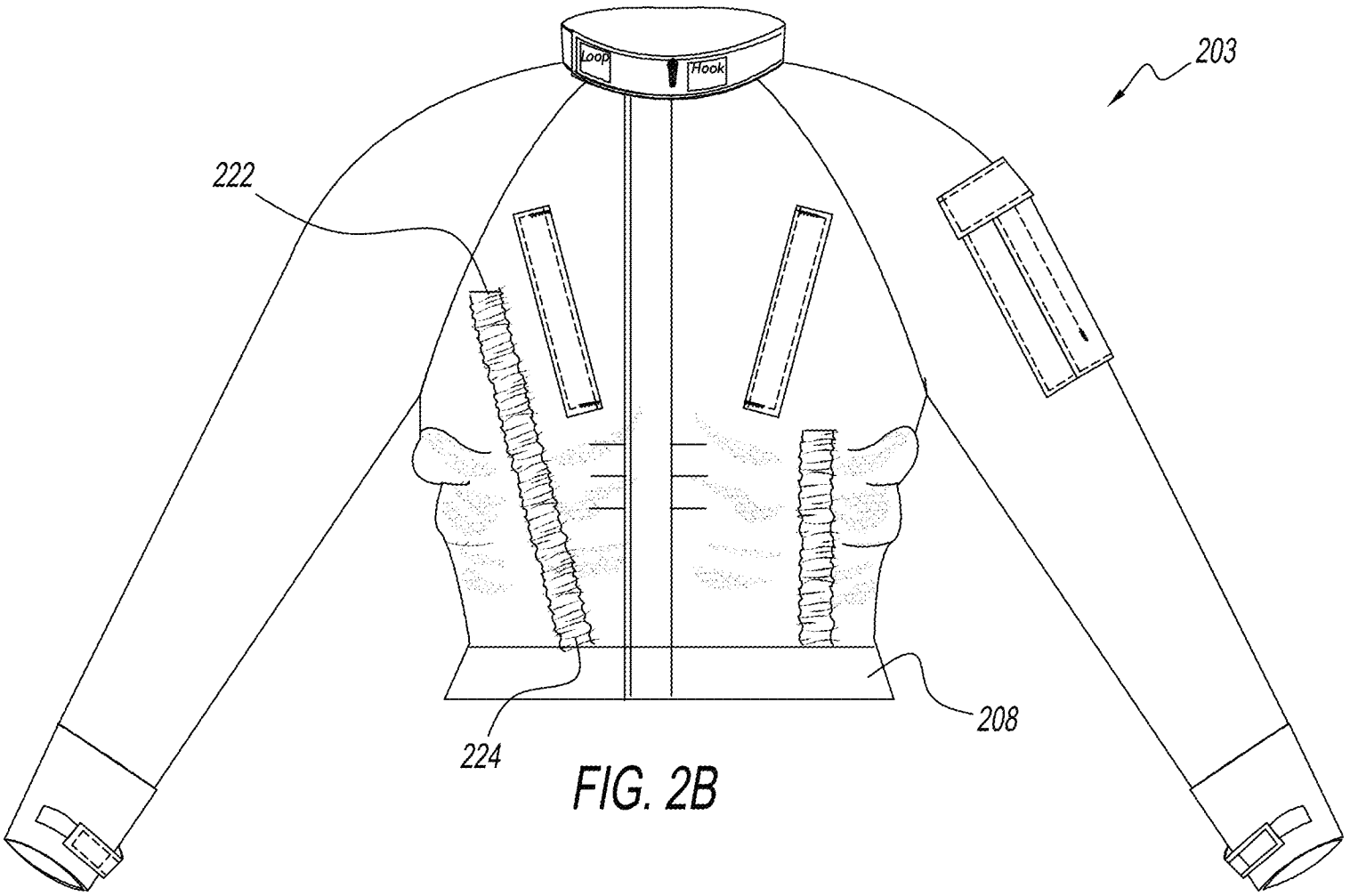
FIG. 2B depicts an embodiment of apparel in accordance with the material disclosed herein.

FIG. 2B depicts an embodiment of apparel 203 in accordance with the material disclosed herein. The apparel 203 is hereinafter referred to as "jacket 203." FIG. 2B depicts a tunnel 222 on the front torso of the jacket 203. The tunnel 222 is on a diagonal angle. A "diagonal angle" as used herein is an angle that is not parallel to either a substantially vertical axis or a substantially horizontal axis. In this embodiment, the tunnel 222 extends from the upper torso to just above the flap 208. Stretched elastomeric material 224 is inserted into the tunnel 222. Thereafter the top edge and bottom edge of the tunnel 222 and elastomeric material 224 are sewn to the jacket 203. The stretched elastomeric material 224 provides as bias on the tunnel 222 causing the tunnel 222 and surrounding material on the jacket 200 to bunch.

Figure 2C:
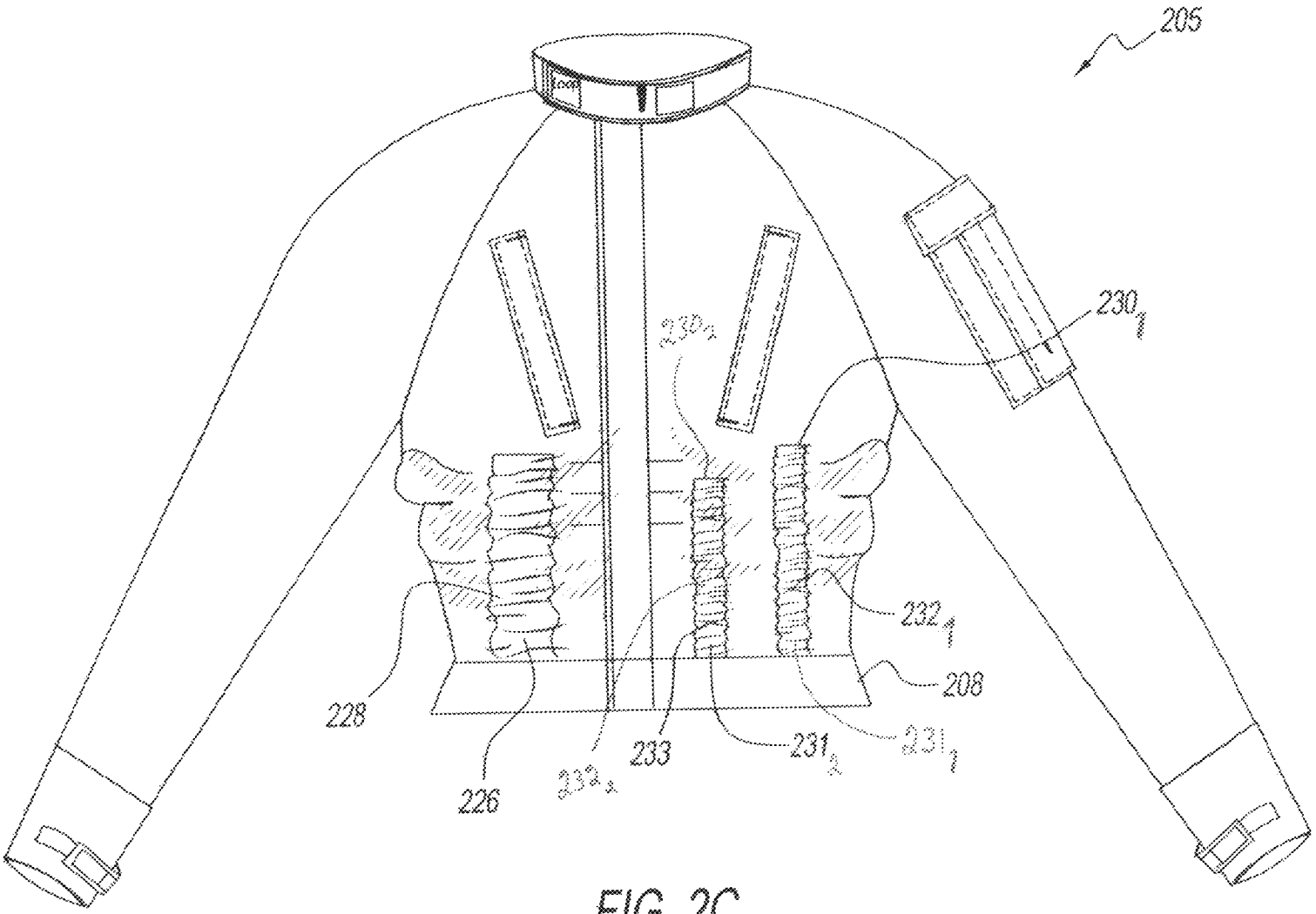
FIG. 2C depicts an embodiment of apparel in accordance with the material disclosed herein.

FIG. 2C depicts an embodiment of apparel 205 in accordance with the material disclosed herein. The apparel 205 is also referred to herein as "jacket 205." The jacket 205 includes tunnels $\mathbf{230}_1$ and $\mathbf{230}_2$ (collectively "tunnels 230") on one side of the front torso. Tunnels 230 are substantially vertical and extend from the mid-torso to the flap 208. Stretched elastomeric materials $\mathbf{232}_1$ and $\mathbf{232}_2$ (collectively "elastomeric materials 232") are inserted into tunnels $\mathbf{230}_1$ and $\mathbf{230}_2$, respectively. Thereafter the top edge and bottom edge of the tunnels 230 and elastomeric materials 232 are sewn to the jacket 205.

On the other side of the front torso is a tunnel 226. Tunnel 226 is substantially vertical and is relatively wider than tunnels 214 and 230 so that tunnel 226 may accommodate a wider piece of elastomeric material than the elastomeric material in tunnels 214 or 230. After insertion of the elastomeric material 228 into tunnel 226 the top end and bottom end of the elastomeric material 228 and tunnel 226 are sewn to the jacket 205.

Figure 2D:
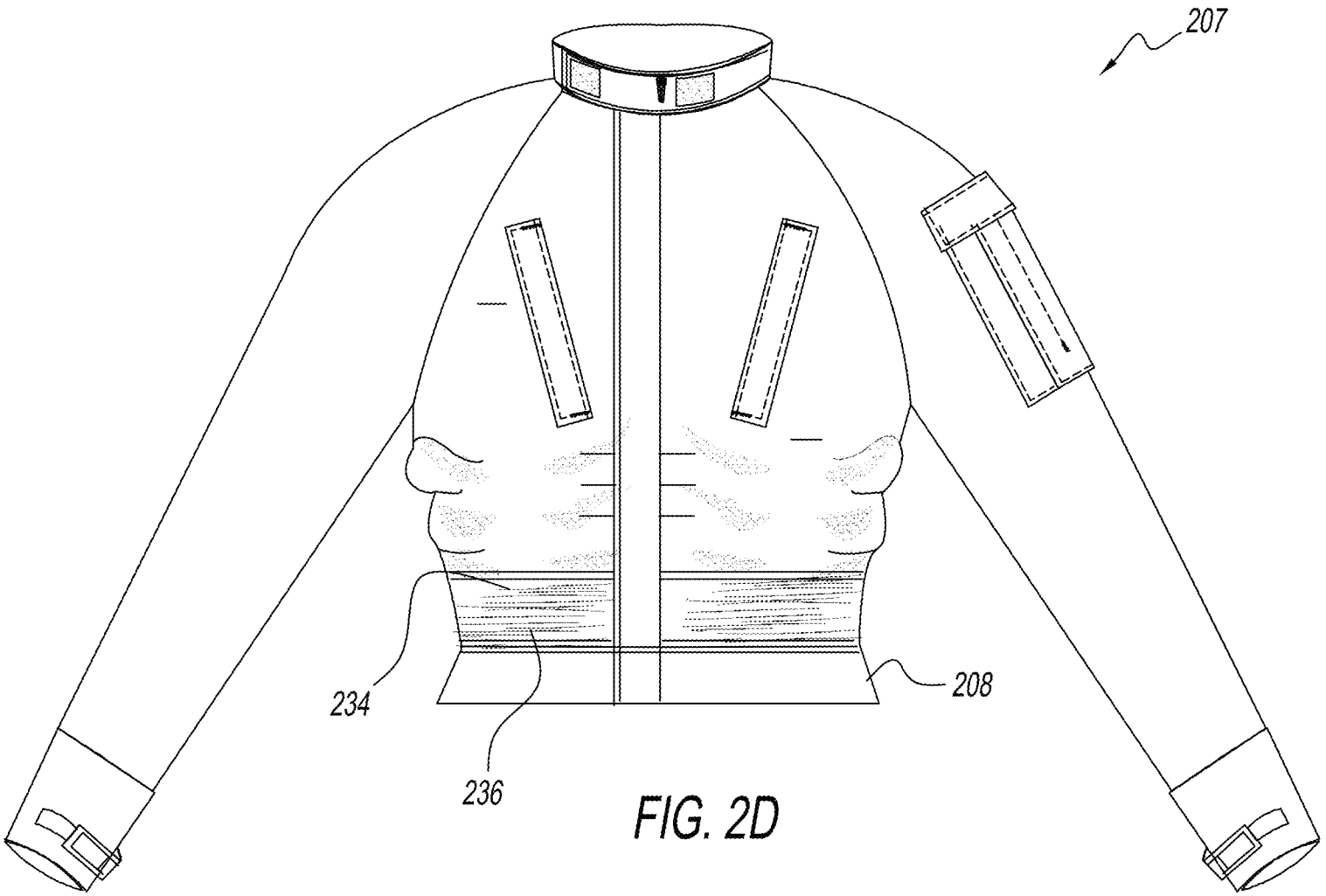
FIG. 2D depicts an embodiment of apparel in accordance with the material disclosed herein.

FIG. 2D depicts an embodiment of apparel 207 in accordance with the material disclosed herein. The apparel 207 is also referred to herein as "jacket 207." The jacket 207 includes at least one horizontal tunnel 234 around the waist of the jacket 207 above the flap 208. Inserted into the tunnel 234 is elastomeric member 236. After insertion of the elastomeric material 236 into tunnel 234 the left end and right end of the elastomeric material 236 and tunnel 234 are sewn to the jacket 207.

Figure 2E:
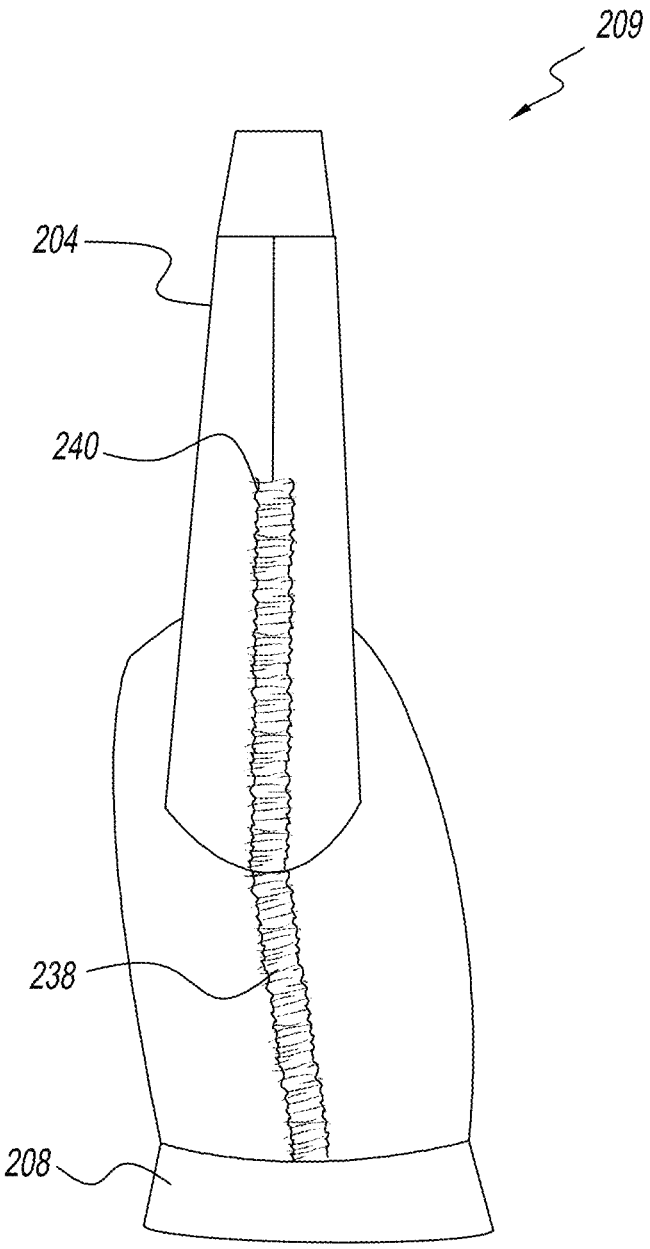
FIG. 2E depicts an embodiment of apparel in accordance with the material disclosed herein.

FIG. 2E depicts an embodiment of a side view of apparel 209 in accordance with the material disclosed herein. The apparel 209 is also referred to herein as "jacket 209." Jacket 209 includes a tunnel 238 between the front of the torso 202 and back of the torso 202. The tunnel 238 has a longitudinal axis that is vertical and substantially perpendicular to the longitudinal axis of the flap 208. The tunnel 238 extends along the armpit of the jacket 209, a portion of the sleeve 204, and a portion of the torso 202 between the armpit and the flap 208. Inserted into the tunnel 238 is elastomeric member 240. After insertion of the elastomeric material 240 into tunnel 238 the top end (located on the sleeve 204) and bottom end (located on the torso 202) of the elastomeric material 240 and tunnel 238 are sewn to the jacket 209.

Figure 2F:
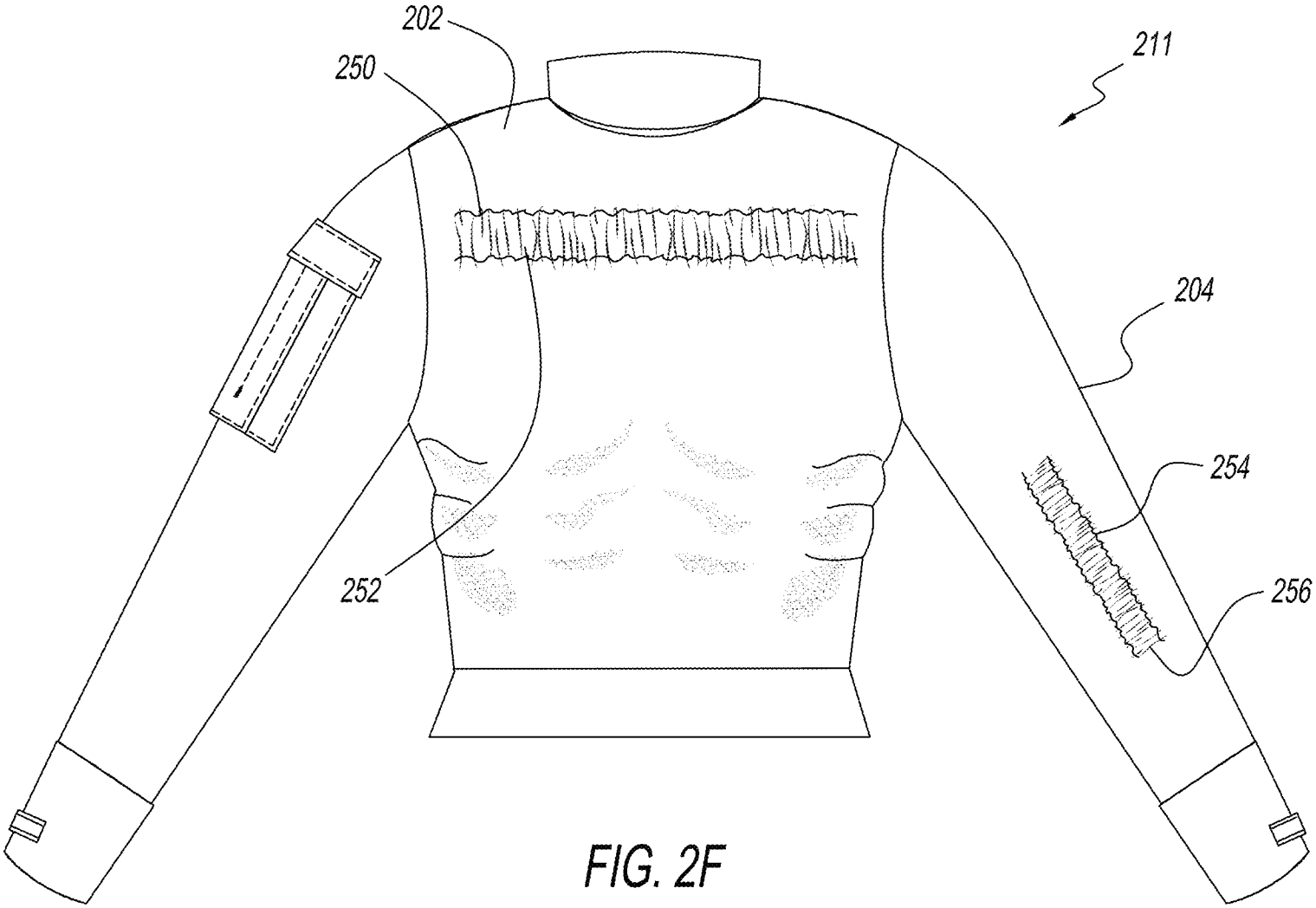
FIG. 2F depicts an embodiment of apparel in accordance with the material disclosed herein.

FIG. 2F depicts an embodiment of a review of apparel in accordance with the material disclosed herein. Illustratively, FIG. 2F is described with respect jacket 200 depicted in FIG. 2A. On the back of the torso 202 is a tunnel 242 that is substantially horizontal and is located between the shoulders and across the upper back of the jacket 200. Inserted into the tunnel 242 is elastomeric member 244. After insertion of the elastomeric material 244 into tunnel 242 the left end and right end of the elastomeric material 244 and tunnel 242 are sewn to the jacket 209.

Figure 3A:
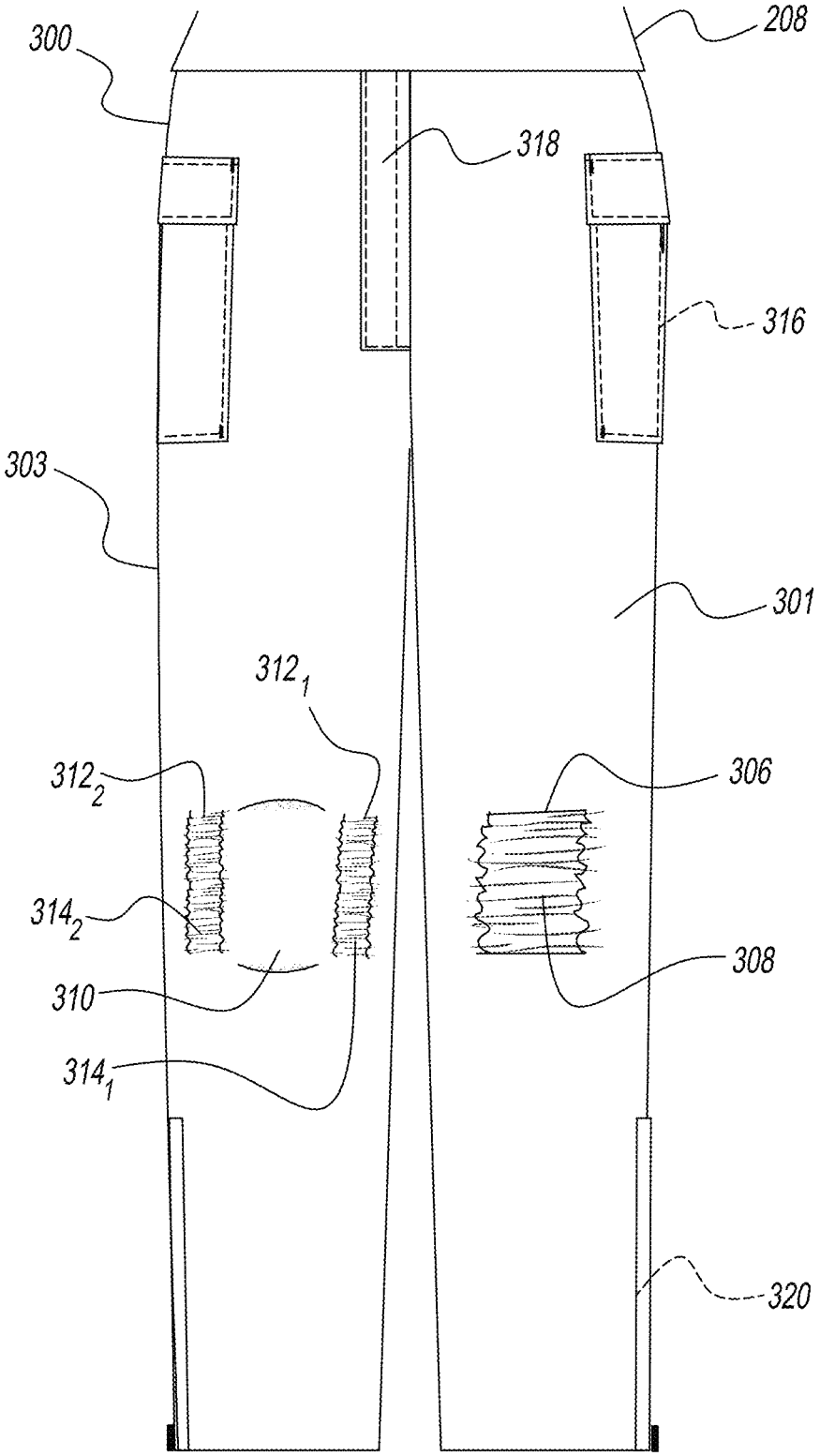
FIG. 3A depicts an embodiment of apparel in accordance with the material disclosed herein.

FIG. 3A depicts an embodiment of apparel 300 in accordance with the material disclosed herein. In various embodiments, the apparel 300 may be worn as pants or coverall bottoms that are worn over pants. The pants 300 includes a flap 302 that covers leg extension (not shown in FIG. 3A) and a vertical flap 318 on the front of the pants 300 and is explained in greater detail below. Also, on the front of the pants 300 are examples of tunnel configurations near the knee section 310 of the legs 301 and 303.

For example, on leg 303 are tunnel $\mathbf{312}_1$ on one side of the front of the knee section 310 and tunnel $\mathbf{312}_2$ (collectively "tunnels 312") on the other side of the front of the knee section 310. An elastomeric material $\mathbf{314}_1$ is inserted into tunnel $\mathbf{312}_1$ and an elastomeric material $\mathbf{314}_2$ is inserted into tunnel $\mathbf{312}_2$. Elastomeric materials $\mathbf{314}_1$ and $\mathbf{314}_2$ are collectively referred to herein as "elastomeric materials 314." After insertion of the elastomeric materials 314 into tunnels 312, the elastomeric materials 314 and tunnels 312 are sewn at the top edge and the bottom edge to the leg 303.

As another example, leg 301 includes a tunnel 306 that covers a portion of the knee section 310. Tunnel 306 is relatively larger than either of the tunnels 312 and may accommodate a larger elastomeric material 308 than the elastomeric materials 314. After insertion of the elastomeric material 308 into tunnel 306, the elastomeric material 308 and tunnel 306 are sewn at the top edge and the bottom edge to the leg 301.

The pants 300 includes optional pockets 316 and optional separable seams 320 on each leg 301 and 303. The separable seams 320 may be held together (e.g., by hook and loop fasteners) until a user separates the separable seams 320 for easier insertion of footwear through the legs 301 and 303. After insertion of the footwear through the legs 301 and 303 the separable seams 320 may be re-secured.

Figure 3B:
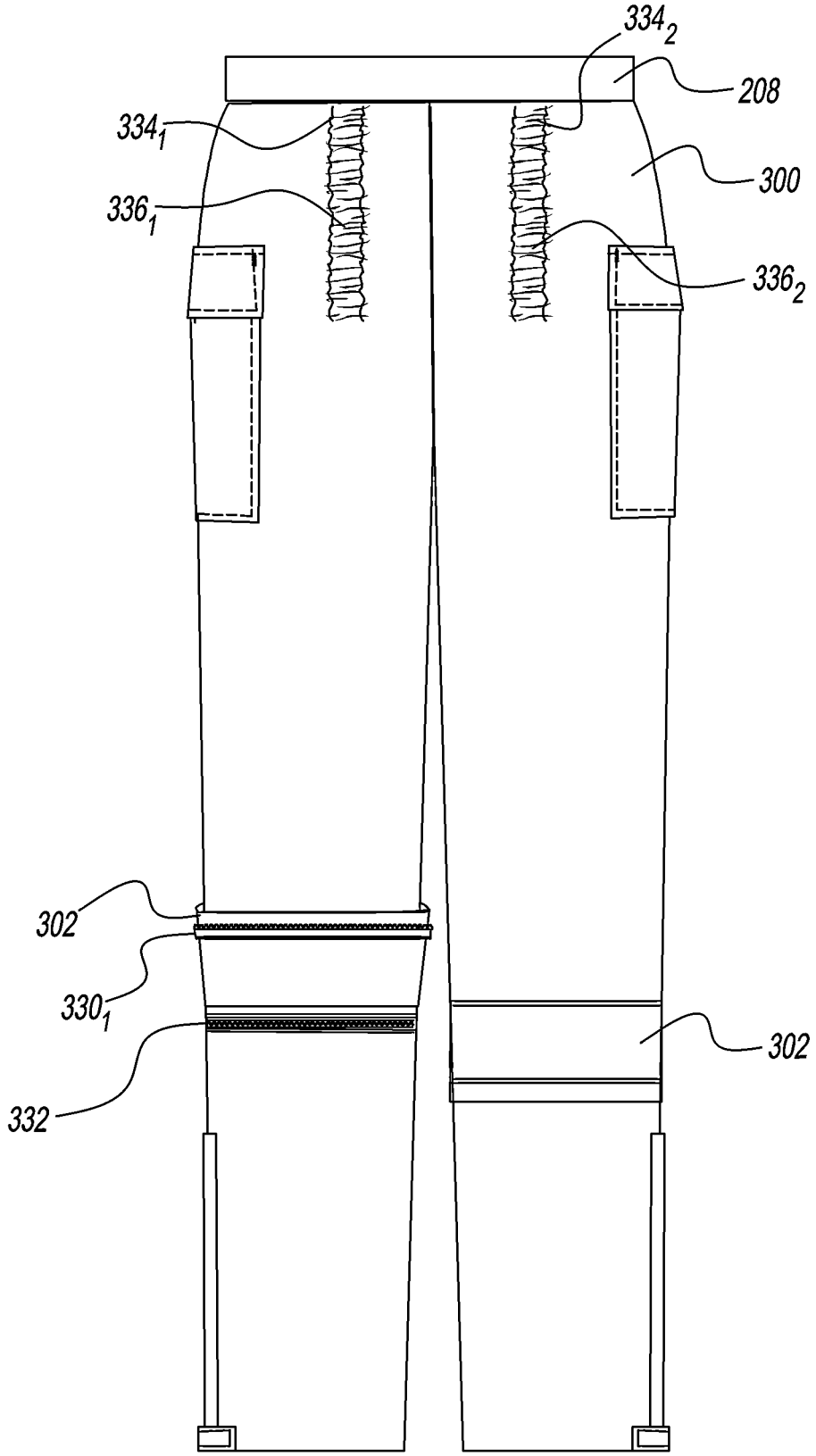
FIG. 3B depicts an embodiment of apparel in accordance with the material disclosed herein.

FIG. 3B depicts a rear view of an embodiment of apparel 300 in accordance with the material disclosed herein. The rear of pants 300 includes a tunnel $\mathbf{334}_1$ and $\mathbf{334}_2$ (collectively "tunnels 334") on each hip cheek. The tunnels 334 are substantially vertical. Inserted into the tunnels $\mathbf{334}_1$ and $\mathbf{334}_2$ are elastomeric materials $\mathbf{336}_1$ and $\mathbf{336}_2$, respectively. FIG. 3B also shows a flap 302 on one leg in a down position and a flap 302 in an up position exposing an unmated zipper track $\mathbf{330}_1$ and a mated zipper 332.

Figure 4:
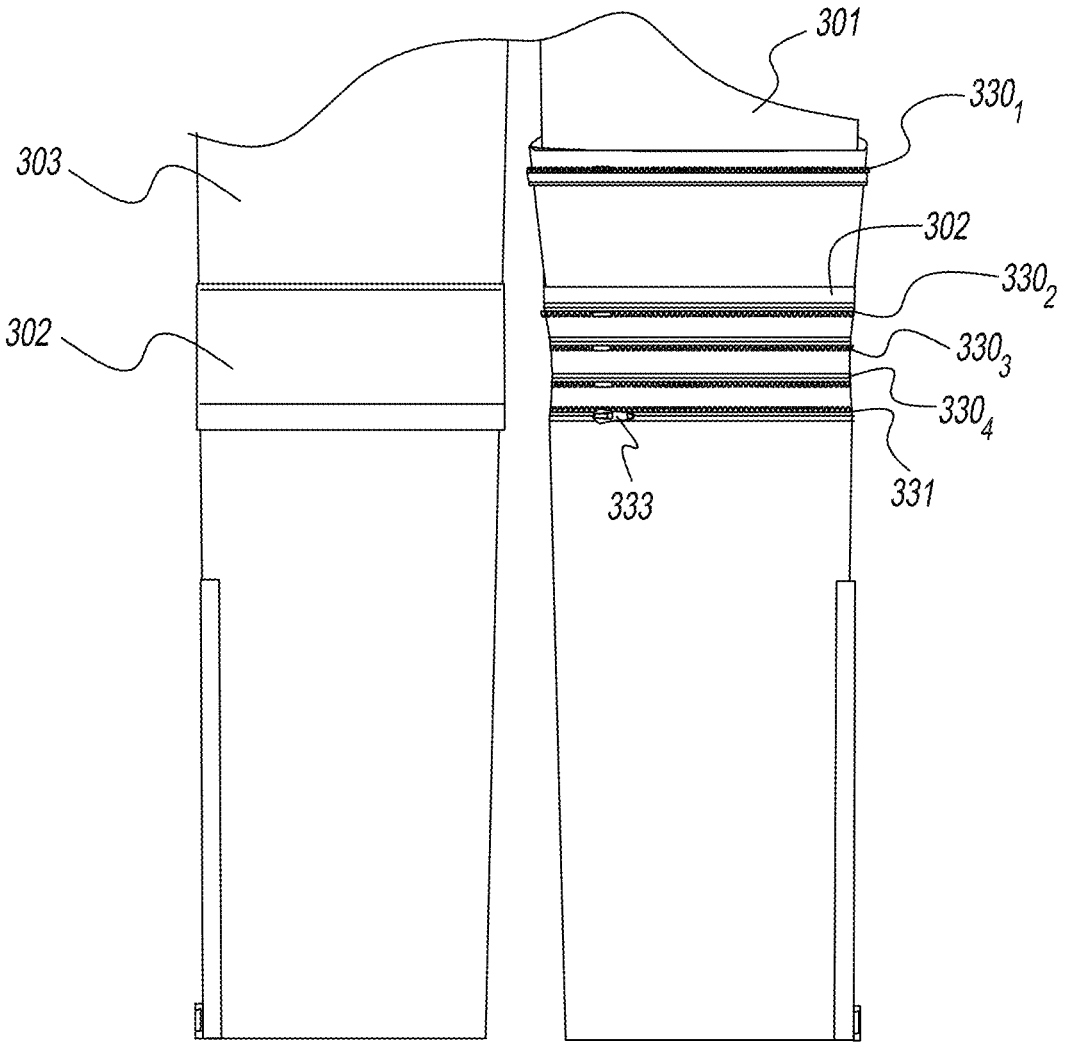
FIG. 4 depicts an embodiment of an apparel extension in accordance with the material disclosed herein.

FIG. 4 depicts an embodiment of an apparel extension in accordance with the material disclosed herein. For illustrative purposes only, the extension is described as located on the legs 301, 303 of the pants 300. However, in various embodiments, these extensions can also be applied to apparel that covers other body parts (e.g., arms, torsos and thighs). In FIG. 4, the flap 302 is in a "down position" on leg 303. In the down position, the flap 302 protects and covers a series of zipper tracks and material that can be used extend or shorten the inseam (i.e., adjust the length of the leg 303) of the pants 300. One zipper track 331 includes a zipper slider 333 and is adapted to mate with any of the zipper tracks $\mathbf{330}_1$, $\mathbf{330}_2$, $\mathbf{330}_3$, or $\mathbf{330}_4$ (collectively "zipper tracks 330"). The zipper tracks 330 are spaced apart so that mating one of the zipper tracks 330 with zipper track 331 either shortens or lengthens the leg 301 depending upon which zipper track 330 is mated with zipper track 331. For example, mating zipper track 331 with zipper track $\mathbf{330}_4$ would provide a shorter inseam than mating zipper track 330 with zipper track $\mathbf{330}_2$. The zipper slider 333 is used to mate the zipper tracks 330 and 331. Element "332" in FIG. 3B is an example of a mated zipper. To cover and protect the zipper tracks 330 and 331 the flap 302 is moved in the down position.

Figure 5A:
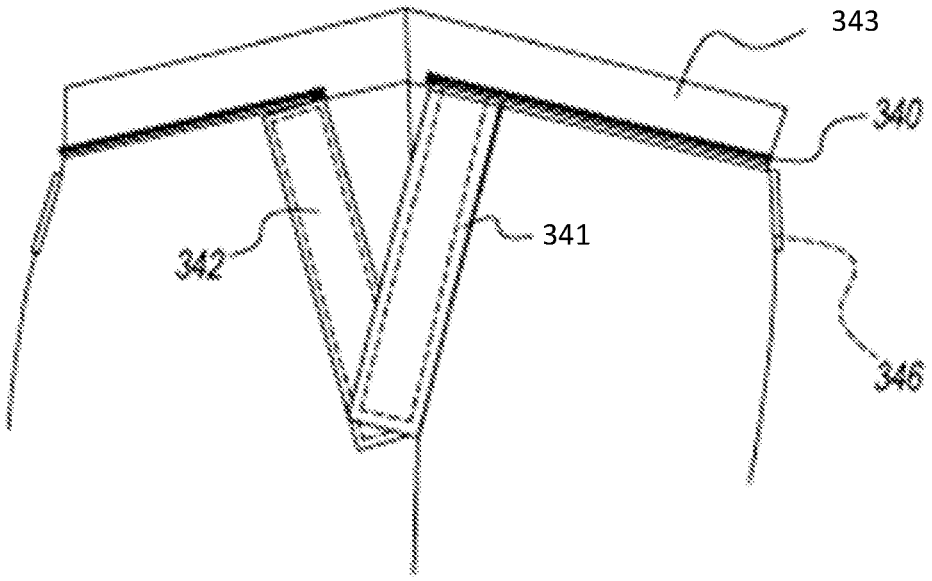
FIG. 5A depicts an embodiment of apparel, in a first position, in accordance with the material disclosed herein.

FIG. 5A depicts an embodiment of apparel, in a first position, in accordance with the material disclosed herein. Specifically, FIG. 5A depicts pants 300 in an "open" position. The flap 318 into two mating components 341 and 342. Illustratively, the two mating components 341 and 342 are described as hook and look fasteners. However, other embodiments include any fastening mechanism that would secure the two mating components 341 and 342 together. A barrier 343 is between the mating components 341 and 342 and a user (not shown). The barrier 343 extends above zipper track 340 and into the area exposed by a "V-shape" formed by the two mating components 341 and 342 while in the open position. The barrier 343 acts as a protective layer for a user from elements (e.g., environmental or hazardous) outside of the pants 300. FIG. SA also shows optional belt loops 346 that are adapted to receive a belt (not shown) around the waist.

Figure 5B:
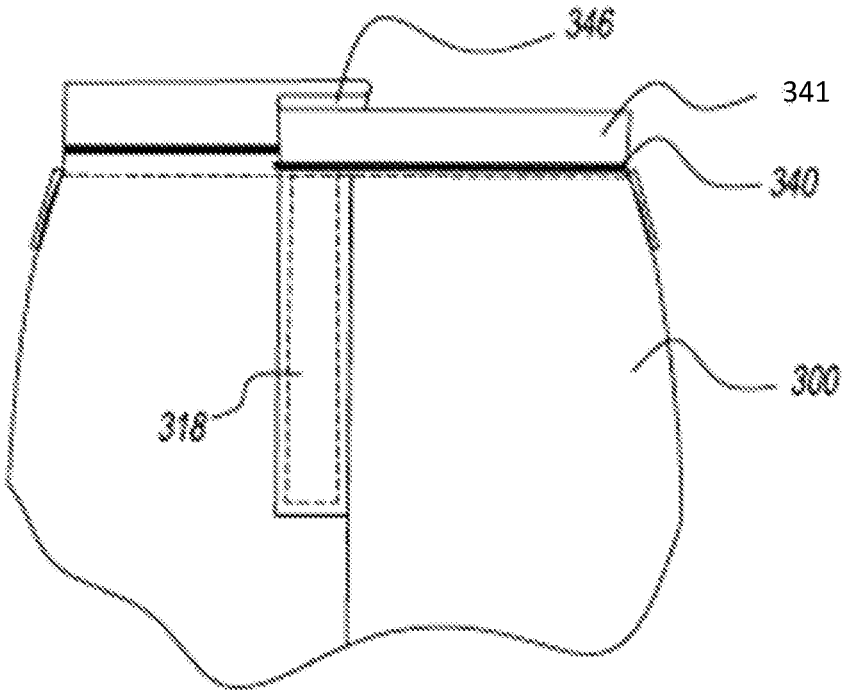
FIG. 5B depicts an embodiment of apparel, in a second position, in accordance with the material disclosed herein.

FIG. 5B depicts an embodiment of apparel, in a second position, in accordance with the material disclosed herein. Specifically, FIG. SB depicts pants 300 in a "closed" position. When in the flap 318 is in the closed position, a portion of the barrier 343 overlaps with itself at a central portion 346.

Figure 6A:
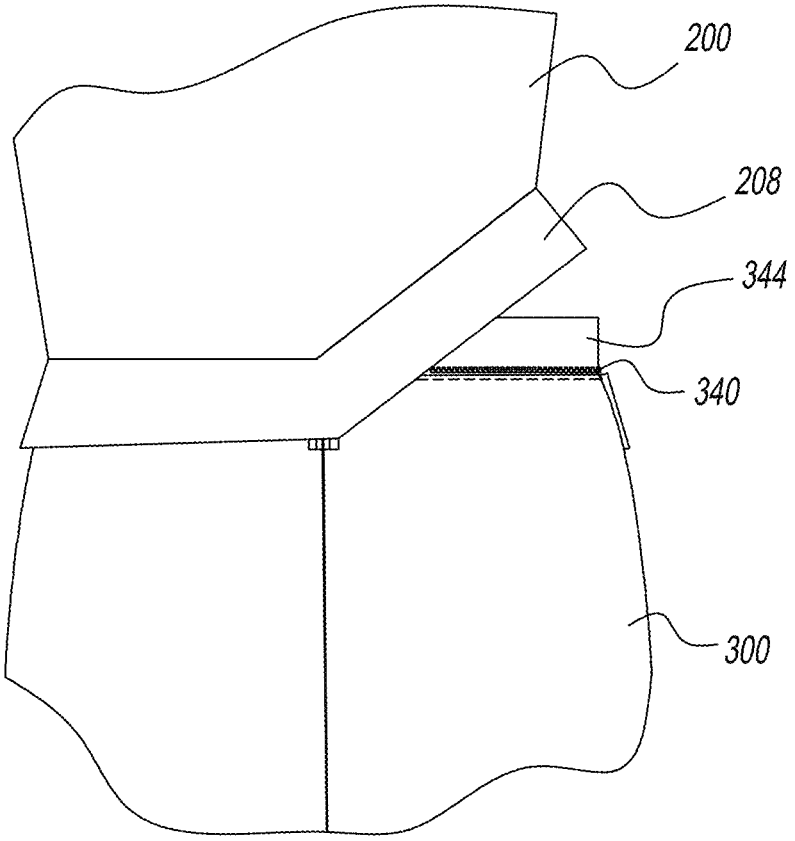
FIG. 6A depicts of an embodiment of apparel in accordance with the material disclosed herein.
Figure 6B:
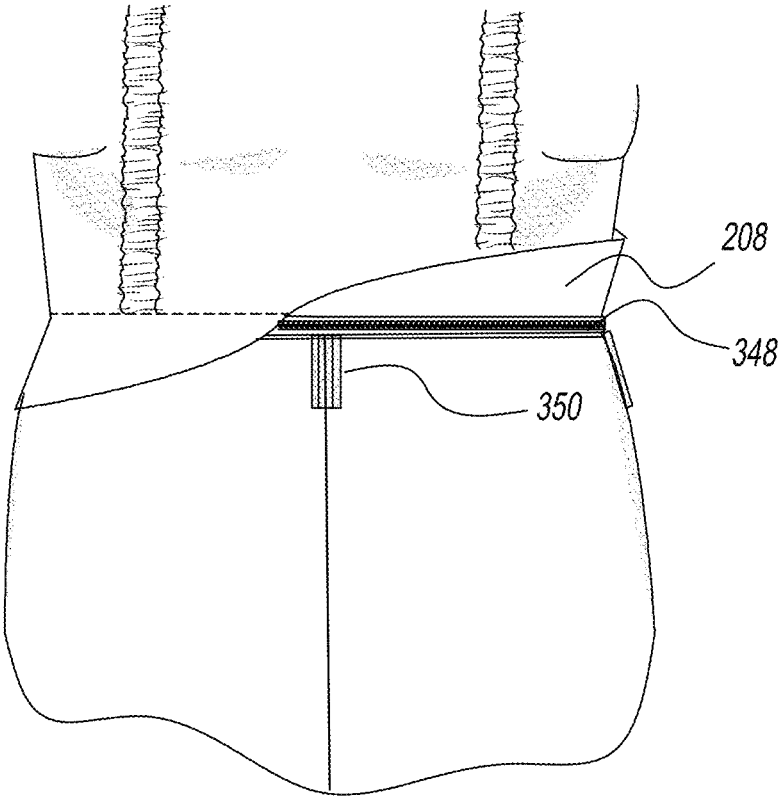
FIG. 6B depicts another view of the embodiment of apparel depicted in FIG. 6A in accordance with the material disclosed herein.

The pants 300 may be secured to the jacket 200 to form coverall 100. FIG. 6A depicts of an embodiment of apparel in accordance with the material disclosed herein. Specifically, FIG. 6A depicts the jacket 200 partially secured to the pants 300 with a portion of the flap 208 in the "up" position; that the flap 208 and barrier 344 overlap when the jacket 200 and pants 300 are secured to each other. In FIG. 6B, the jacket 200 and pants 300 are secured by mating zipper track 340 with another zipper track located on the jacket 200 behind flap 208 to form mated zipper 348. A zipper slide 350 was used to mate/unmate zipper track 340 on the pants 300 with the corresponding zipper track on the jacket 200. Although the zipper slide 350 is depicted as being centrally located in the front of the coverall 100 this location is not required.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

In the embodiments described herein, and depicted in the FIGs., some components are depicted and described as a single component. However, these depictions and descriptions are not intended, in any way, to limit the scope of the material taught herein.

An "Abstract" is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. Apparel comprising:

a torso comprising a shell fabric wherein the torso includes a front, a back, a first side connecting the front to the back, a second side connecting the front to the back, a bottom, and a top, the bottom and top defining a longitudinal direction from the neck to the waist of a wearer;

a plurality of bunching tunnels at least one of which extends in the longitudinal direction and is located on the shell fabric and each bunching tunnel comprising a tunnel of extra shell fabric with an elastomeric member located therein and sewn to the shell fabric in a stretched state, the elastomeric member configured to urge the shell fabric and the extra shell fabric to bunch together when the elastomeric member contracts to a relaxed state, wherein the plurality of bunching tunnels function to provide further bunched shell fabric on the first side and the second side of the torso;

pleats on the front of the torso;

a centrally located torso flap on the torso extending in the longitudinal direction and spaced from a set of sleeves connected to the torso;

a protective flap extending peripherally along the bottom of the torso, wherein at least one of the plurality of bunching tunnels extends at an acute angle to the longitudinal direction along the front of the torso;

a first zipper track located on the bottom of the torso and behind the protective flap; a second zipper track coupled to and above a waist portion and adapted to mate with the first zipper track;

a vertical flap extending downward and away from the waist portion wherein, the vertical flap comprises two vertical pieces that each includes a proximal end and a distal end, the distal ends of the two vertical pieces are directly connected to each other;

a protective barrier connecting the proximal ends of the two vertical pieces, the protective barrier extends upwards and away from the waist portion and the protective barrier is connected to the directly connected distal ends; and two legs extending from the waist portion wherein each of the two legs include:

multiple zipper tracks wherein each of the multiple zipper tracks is separated from one another by extension material, wherein another zipper track is adapted to mate with any of the multiple zipper tracks, and a leg flap exposing the multiple zipper tracks and the another zipper track when the leg flap is in a first position and covering the multiple zipper tracks and the another zipper track when the leg flap is in a second position.

2. The apparel of claim 1 wherein the plurality of bunching tunnels are located on the front of the torso.

3. The apparel of claim 2 further comprising at least one additional bunching tunnel located on the back of the torso.

4. The apparel of claim 2 further comprising at least one additional bunching tunnel on each sleeve of the set of sleeves.

5. The apparel of claim 1 wherein each sleeve of the set of sleeves include cuffs having straps thereon adapted to adjust cuff measurements and further comprising:

a collar having a hook and loop fastener adapted to adjust collar measurements; and at least one pocket on the torso or on an individual sleeve of the set of sleeves.

6. The apparel of claim 1 wherein the protective flap is adapted to cover the mating of the first zipper track with the second zipper track.

7. The apparel of claim 1 wherein the front of the torso retains a plurality of shell fabric portions.

8. The apparel of claim 1 wherein the plurality of shell fabric portions is diagonal on the front of the torso.

9. The apparel of claim 1 further comprising at least one additional shell fabric portion of the back of the torso and is adapted to receive another elastomeric member.

10. The apparel of claim 1 further comprising at least one additional shell fabric portion on each sleeve of the set of sleeves, wherein each at least one additional sleeve shell fabric portion of each sleeve of the set of sleeves is adapted to receive an elastomeric member.

11. The apparel of claim 1 wherein the shell fabric portion on each sleeve of the set of sleeves is also on the torso.

12. The apparel of claim 1 further comprising at least one additional shell fabric portion on each leg, wherein each at least one additional shell fabric is adapted to receive an elastomeric member.

13. The apparel of claim 1 wherein the at least one additional shell fabric portion is on a kneecap portion of each leg and wherein the at least one additional shell fabric portion is a shell fabric portion on a seat portion below the waist.

* * * * *